United States Patent [19]

Knox, Jr.

[11] Patent Number: 4,749,030

[45] Date of Patent: Jun. 7, 1988

[54] DEVICE FOR CONDENSING ORGANIC SOLVENTS

[76] Inventor: Arthur C. Knox, Jr., 525 Purcell Ave., Cincinnati, Ohio 45205

[21] Appl. No.: 103,119

[22] Filed: Sep. 28, 1987

[51] Int. Cl.[4] ..... F28B 3/00

[52] U.S. Cl. ..... 165/111; 165/113; 55/269; 202/185 E

[58] Field of Search ..... 165/111, 112, 113, 114, 165/156, 163, 160; 55/269; 62/93; 202/185.5, 185.6; 34/73, 75

[56] References Cited

U.S. PATENT DOCUMENTS

| | | | |
|---|---|---|---|
| 949,217 | 2/1910 | Caps | 55/269 |
| 1,397,621 | 11/1921 | Corbin | 165/111 |
| 1,641,660 | 9/1927 | Bryant | 165/111 |
| 1,947,863 | 2/1934 | Mahoney | 165/113 |
| 2,425,669 | 8/1947 | Brock | 165/111 |
| 3,818,718 | 6/1974 | Freese | 165/111 |
| 4,471,836 | 9/1984 | Hokanson | 165/111 |

FOREIGN PATENT DOCUMENTS

| | | | |
|---|---|---|---|
| 634917 | 3/1950 | United Kingdom | 165/111 |
| 670440 | 4/1952 | United Kingdom | 165/111 |
| 620799 | 8/1978 | U.S.S.R. | 165/111 |

*Primary Examiner*—James C. Yeung

*Attorney, Agent, or Firm*—James W. Pearce; Roy F. Schaeperklaus

[57] ABSTRACT

A condenser for separating solvent vapors from non-condensable gases. The condenser includes an outer shell, a middle shell inside the outer shell, and an inner shell inside the middle shell. The shells are coaxial and the middle shell is open at the bottom. Mixed solvent vapors and non-condensing gas pass downwardly through an annular space between the inner and middle shells. There is a condensate receiving chamber in the outer shell below the lower end of the middle shell. A cold trap is mounted in the upper portion of the condensate receiving chamber. Coolant is introduced into the cold trap to cool the cold trap. Helical tube means mounted on the cold trap receives the coolant from the cold trap. The helical tube means extends upwardly through the annular space between the inner and middle shells and discharges into an upper portion of the inner shell, and is removed from the inner shell. Condensate is withdrawn from the chamber in the lower portion of the outer shell. The non-condensable gas passes upwardly from the lower end of the middle shell through an annular space between the middle shell and the outer shell into a collecting space in an upper end portion of the outer shell. The non-condensable gas is withdrawn from the collecting space.

5 Claims, 5 Drawing Sheets

DEVICE FOR CONDENSING ORGANIC SOLVENTS

BACKGROUND OF THE INVENTION

This invention relates to a device for condensing organic solvents and the like which are associated with substantially non-condensable gases and for separating the condensed solvents from the non-condensable gases.

An object of this invention is to provide a condenser which directs vapors of mixed solvents and non-condensable gases between helical coolant coils, which are arranged between shell members which direct the mixed solvents and non-condensables around the helical coils. Helical coolant coils arranged between shells are shown in Hokanson U.S. Pat. No. 4,471,836, but for use in a vent condenser.

A further object of this invention is to provide such a solvent condenser in which condensed solvents drop downwardly from the helical coolant coils into a storage portion of an outer shell of the device and in which a cold trap is mounted above the storage portion to capture any solvent which tends to move upwardly from the storage portion.

A further object of this invention is to provide such a solvent condenser which can operate continuously.

BRIEF DESCRIPTION OF THE INVENTION

Briefly, this invention provides a condenser for separating solvent vapors from non-condensable gases which includes a substantially enclosed outer shell, a middle shell inside the outer shell, the middle shell being open at a lower end, and a substantially enclosed inner shell coaxial with the middle shell. Generally helical coolant tubes engage the middle shell and the inner shell to form helical channel means between the inner shell and the middle shell through which the mixed solvent vapor and noncondensable gases pass in contact with the helical tubes, the solvents condensing and falling from the open end of the middle shell to a condensed solvent connecting space. The non-condensable gases pass upwardly through a space between the middle and outer shells to a non-condensable collecting space from which the non-condensables are removed. A coolant containing cold trap is disposed above the condensed solvent collecting space to catch any portion of the solvents which tend to move upwardly from the solvent collecting storage space.

BRIEF DESCRIPTION OF THE DRAWINGS

The above and other objects and features of the invention will be apparent to those skilled in the art to which this invention pertains from the following detailed description and the drawings, in which.

DESCRIPTION OF PRESENTLY PREFERRED EMBODIMENT

Figure 1:
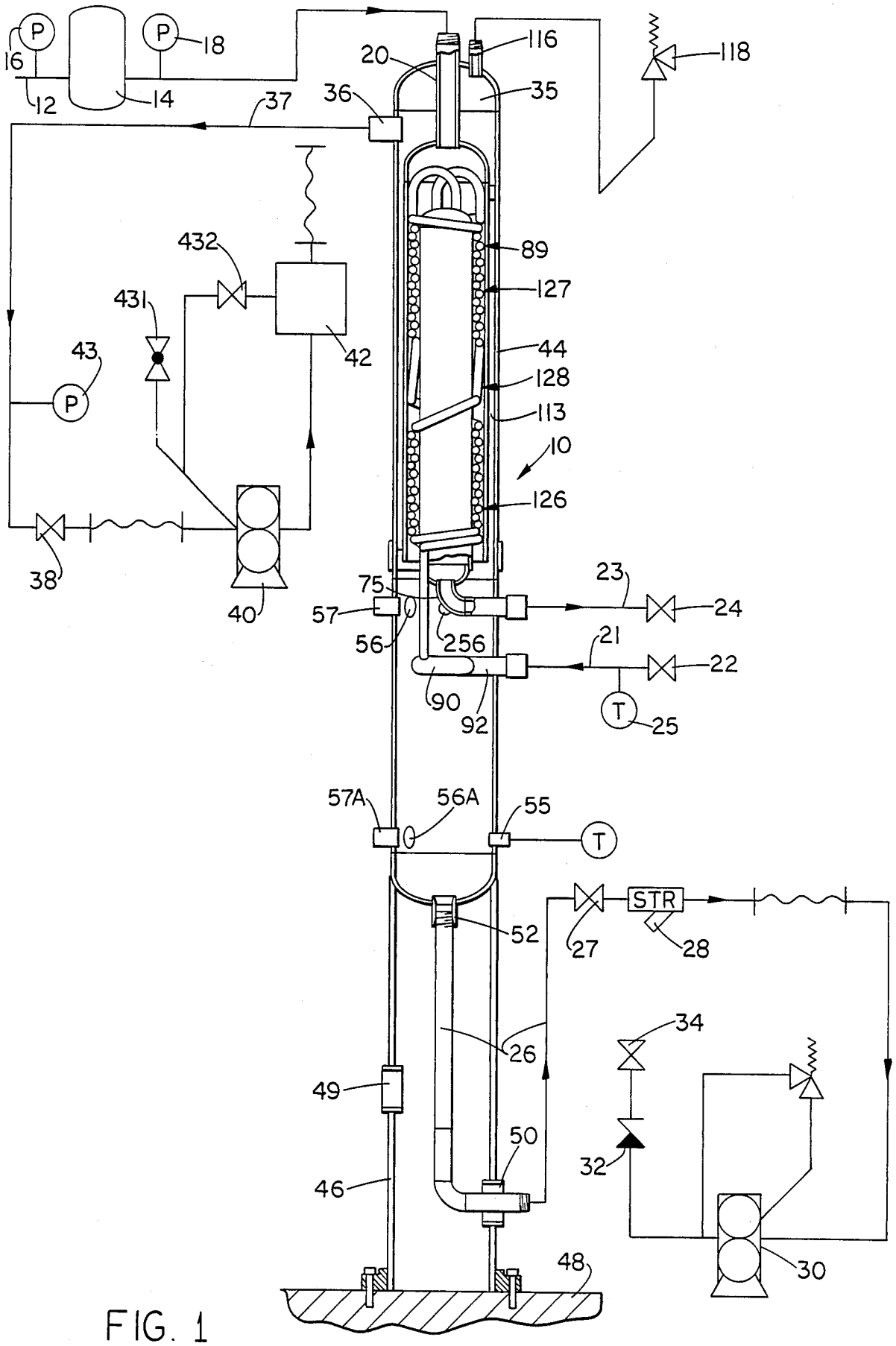
FIG. 1 is a schematic view of a device for separating solvent vapors from non-condensable gases which is constructed in accordance with an embodiment of this invention.

In the following detailed description and the drawings, like reference characters indicate like parts.

In FIG. 1 is shown a solvent recovery system which includes a column or tower 10, which is constructed in accordance with an embodiment of this invention. A vapor mixture of recoverable solvent and non-condensable gases, such as the components of air and the like, enters the system through a line 12. The mixture can pass through a filter 14. Pressure gauges 16 and 18 monitor the vapor mixture. The mixture enters the column through an intake tube 20. Coolant enters the column 10 through a line 21 and a valve 22, and is removed through a line 23 and a valve 24. The temperature of the entering coolant can be shown on a thermometer 25. Condensed solvents are removed through a line 26 and pass through a valve 27, a strainer 28, and a condensate pump 30, to be discharged through a check valve 32 and a manual valve 34.

Non-condensable gases and a small portion of the solvents are discharged from a collecting space 35 in the upper portion of the column 10 through a pipe fitting 36, a line 37, a valve 38, a vacuum pump 40, and an after filter 42. The pressure in the line 37 and in the collecting space 35 is shown by a pressure gauge 43. A ballast valve 431 permits entry of air into the vacuum pump 40, if desired. Non-condensable gases from the after filter 42 can be recycled to the vacuum pump 40 by action of a valve 432 if desired.

The column 10 includes a substantially enclosed outer shell 44, which is supported on an upright tubular stand 46. A mounting ring 47 can be attached to the stand 46 and can be mounted on a suitable support 48. Hand hole rings 49 and 50 are mounted in the stand 46 to give access to the line 26. An entry end portion of the line 26 is mounted in a fitting 52, which is attached in an opening 54 in the lower end portion of the outer shell 44. A short pipe fitting 55 is mounted in the outer shell 44 near the bottom thereof for mounting a thermometer (not shown in detail). Sight glasses 56 and 56A are mounted in the outer shell 44 to show high and low levels of condensed solvents. Short pipe fittings 57 and 57A are mounted in the outer shell 44 adjacent the sight glasses 56 and 56A, respectively, for support of level switches (not shown) which can automatically control the condensate pump 30 to allow continuous condensing. A mount 256 is provided for a vacuum gauge (not shown).

Figure 2A:
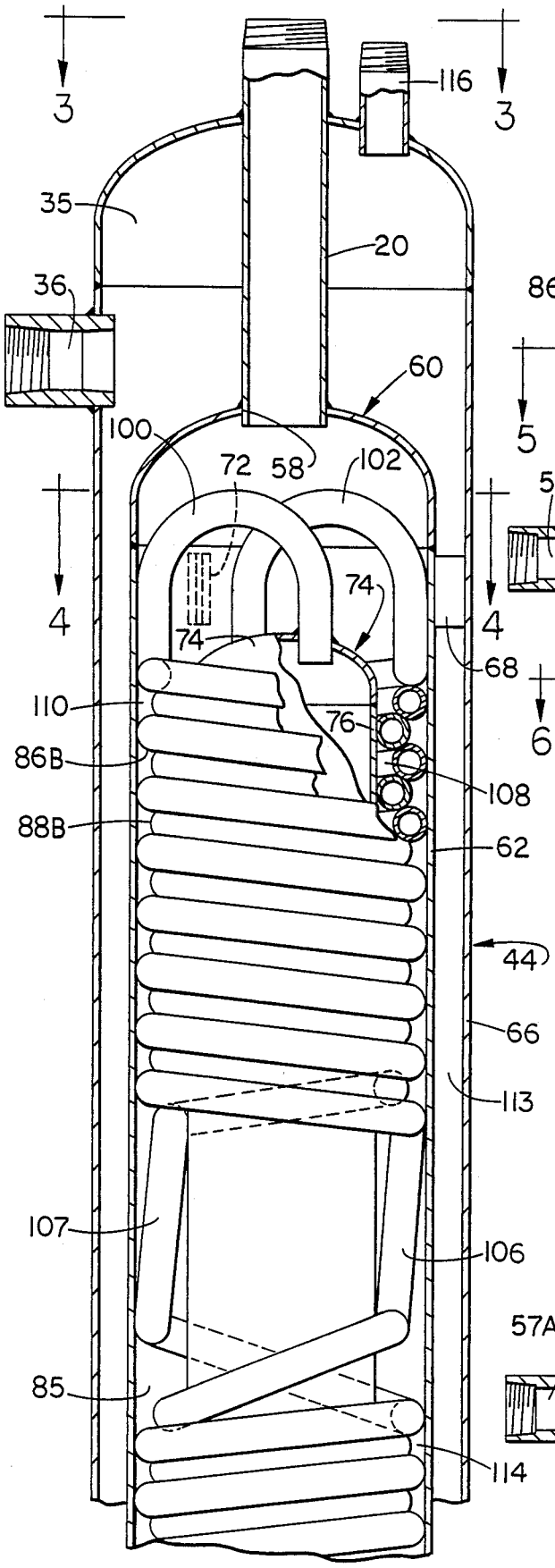
FIG. 2A is a view in upright section of an upper portion of a tower of the device.
Figure 2B:
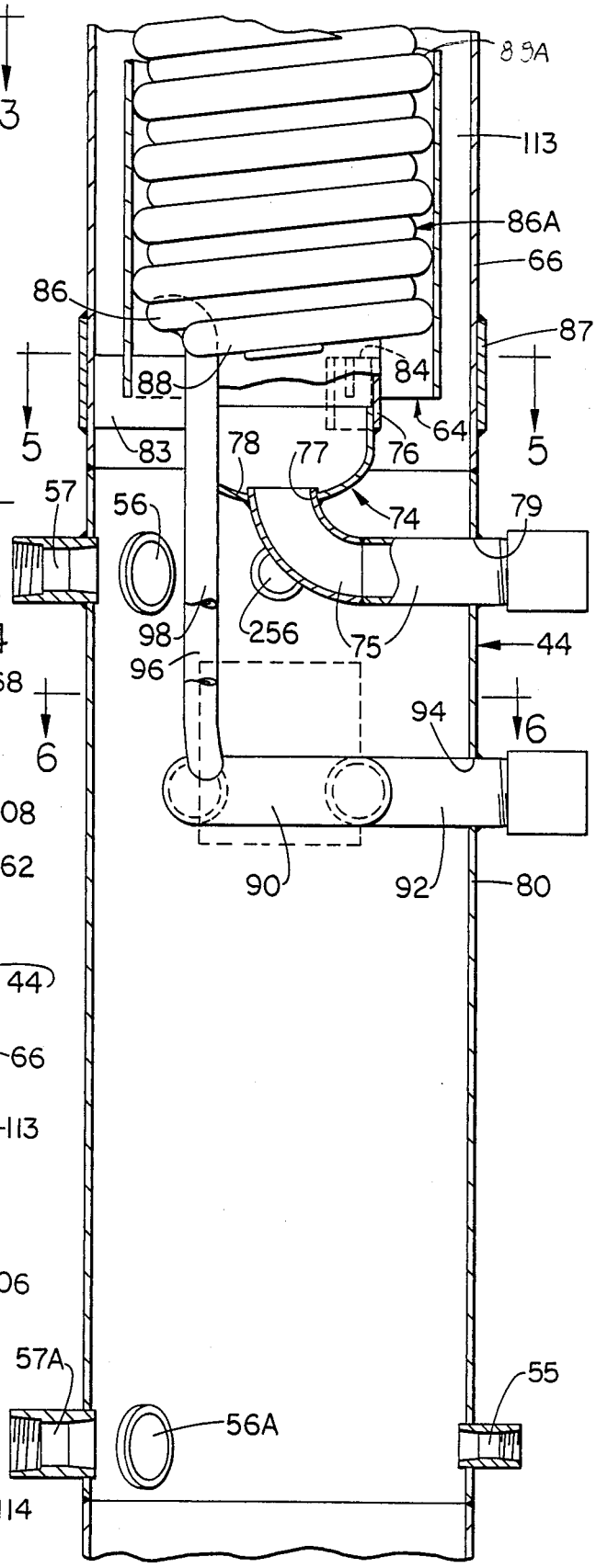
FIG. 2B is a view in upright section of a central portion of the tower.
Figure 2C:
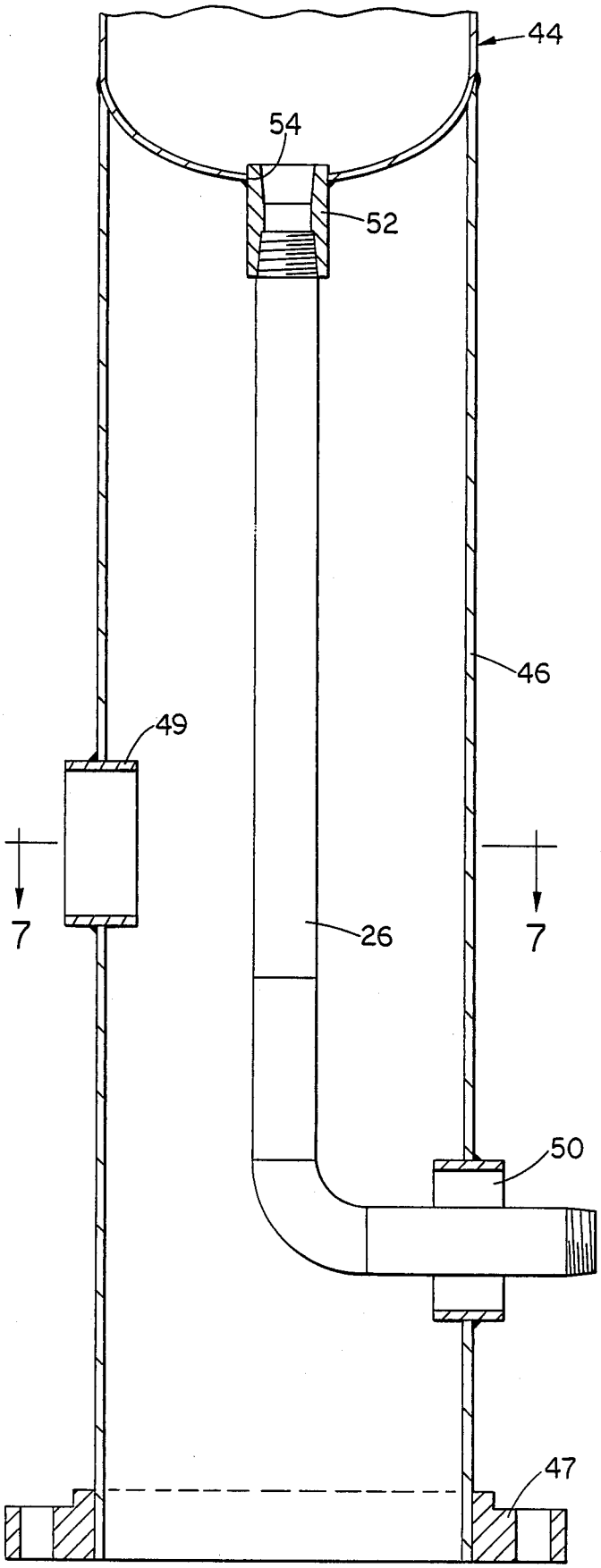
FIG. 2C is a view in upright section of a lower portion of the tower.
Figure 3:
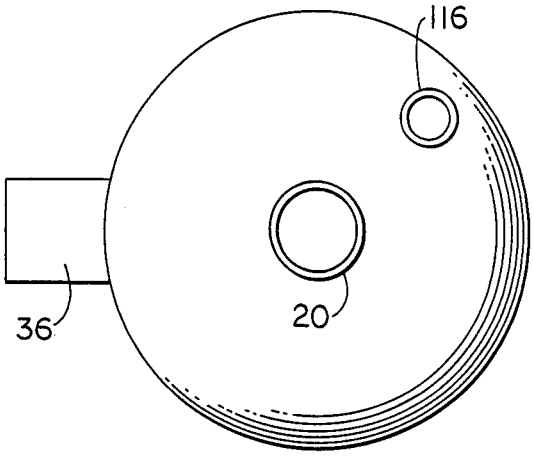
FIG. 3 is a view in section taken on the line 3—3 in FIG. 2A.
Figure 4:
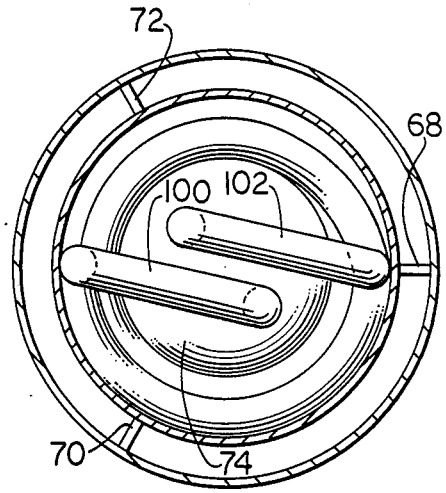
FIG. 4 is a view in section taken on the line 4—4 in FIG. 2A.
Figure 5:
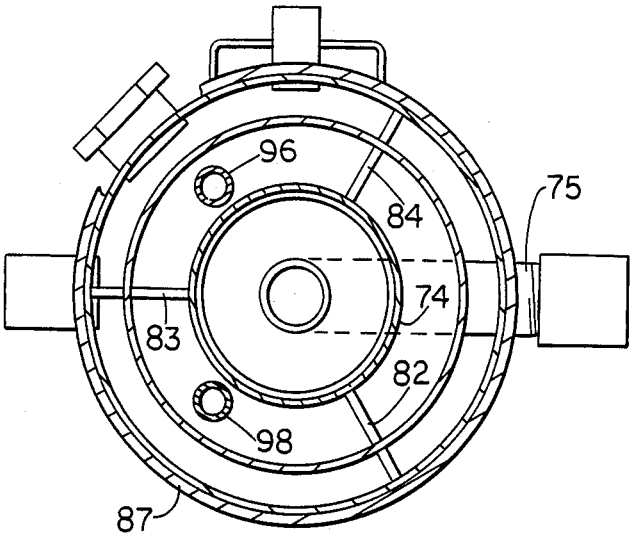
FIG. 5 is a view in section taken on the line 5—5 in FIG. 2B, a strengthening band being partly broken away for clarity.
Figure 6:
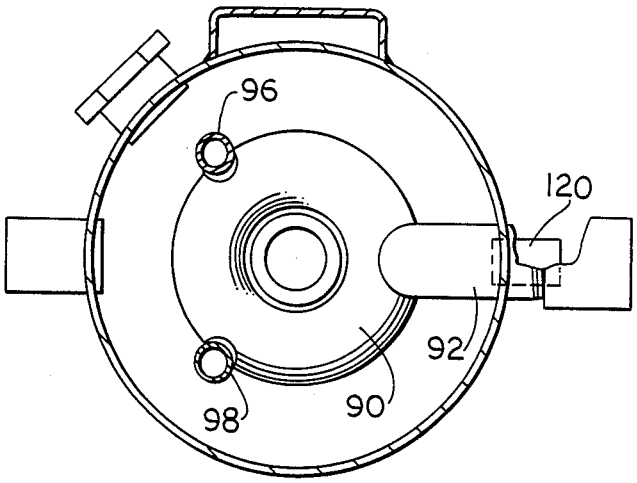
FIG. 6 is a view in section taken on the line 6—6 in FIG. 2B.
Figure 7:
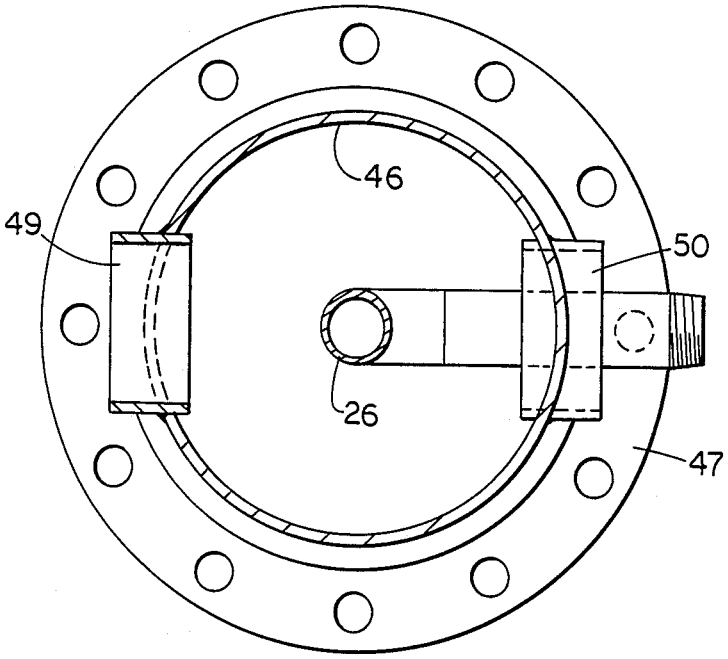
FIG. 7 is a view in section taken on the line 7—7 in FIG. 2C.

A lower end portion of the intake tube 20 is mounted in an opening 58 in an upper end portion of amiddle shell member 60. A tubular wall 62 of the middle shell member is open at the bottom as indicated at 64 (FIG. 2B). The tubular wall 62 is coaxial with and radially spaced from a main wall 66 of the outer shell 44. Radial struts 68, 70, and 72 (FIG. 4) extend between upper portions of the outer and middle shells to hold the upper portions of the outer and middle shells in spaced relation. An inner shell 74 is mounted inside the middle shell 60 with the tubular wall 62 of the middle shell coaxial with a tubular wall 76 of the inner shell 74. A pipe 75, which is part of the coolant removal line 23, is mounted in an opening 77 in a bottom panel 78 of the inner shell 74 and in an opening 79 in an upright wall 80 of the outer shell 44 to hold the inner shell in position. Radially extending struts 82, 83, and 84 (FIG. 5) hold the upright walls of the shells in position at the lower end portions thereof. A strengthening band 87 circles the outer shell 44.

An annular space 85 is formed between the inner shell 74 and the middle shell 60. Elongated, generally helical heat exchange coils 86 and 88 are mounted in the space 85. The coils 86 and 88 form a coil assembly 89. The helical heat exchange coils 86 and 88 are mounted on a cold trap ring 90, which receives coolant from the line 21. The cold trap ring 90 serves to trap condensate which has fallen into the lower portion of the outer shell below the cold trap ring 90 and prevents revaporization and upward migration of the condensate by having the coldest coolant flowing through the cold trap ring 90.

The cold trap ring 90 is supported by a pipe 92, which is a part of the coolant entry line 21. The pipe 92 is supported in an opening 94 in the main wall 66 of the outer shell 44 and communicates with the interior of the cold trap ring 90. Coolant is discharged from the cold trap ring 90 through upright sections 96 and 98 of the generally helical heat exchange coils 86 and 88, respectively. The coolant progresses upwardly of the heat exchange coils 86 and 88 to return bend sections 100 and 102, which discharge into the interior of the inner shell 74 to be discharged through the coolant discharge pipe 75 which is a part of the coolant discharge line 23.

The generally helical heat exchange coil 86 includes a lower section 86A, which engages the tubular wall 76 of the inner shell 74, and an upper section 86B, which engages the tubular wall 62 of the middle shell member 60. A cross-over section 106 connects the lower section 86A and the upper section 86B.

The generally helical heat exchange coil 88 includes a lower section 88A, which engages the tubular wall 62 of the middle shell member 60, and an upper section 88B, which engages the tubular wall 76 of the inner shell 74. A cross-over section 107 connects the lower section 88A and the upper section 88B.

The upper sections 86B and 88B engage each other to form an inner helical conduit 108 and an outer helical conduit 110. The inner conduit 108 is defined by the wall 76 of the inner shell 74 and by the upper sections 86B and 88B. The outer helical conduit 110 is defined by the wall 62 of the middle shell 44 and the upper sections 86B and 88B. Similarly, the lower sections 86A and 88A engage each other to define with the middle shell 60 and the inner shell 74, an inner helical conduit (not shown in detail) and an outer helical conduit 114.

An annular space 113 is formed between the wall 62 of the middle shell 60 and the wall 66 of the outer shell 44 through which non-condensable gases can progress from the open bottom 64 of the middle shell 60 to the collecting space 35. A pipe 116 mounted on the outer shell 44 connects to a relief valve 118.

The device shown in FIGS. 1–7, inclusive, includes a lower coil section assembly 126 including coil sections 86A and 88A, an upper coil section assembly 127 including the coil sections 86B and 88B, and a single intermediate cross-over assembly 128, which includes the cross-over sections 106 and 107, to form the coil assembly 89.

The structure of the coil assembly permits expansion and contraction of the coils on opposite sides of the cross-over sections 106 and 107 as the material carried by the coils is heated or cooled. Moreover, although both of the helical coils 86 and 88 can be of the same diameter, the heat transfer surface area of one of the coils can be the same as that of the other of the coils because a portion of each coil is an inner coil section and a portion of each coil is an outer coil section.

Figure 8:
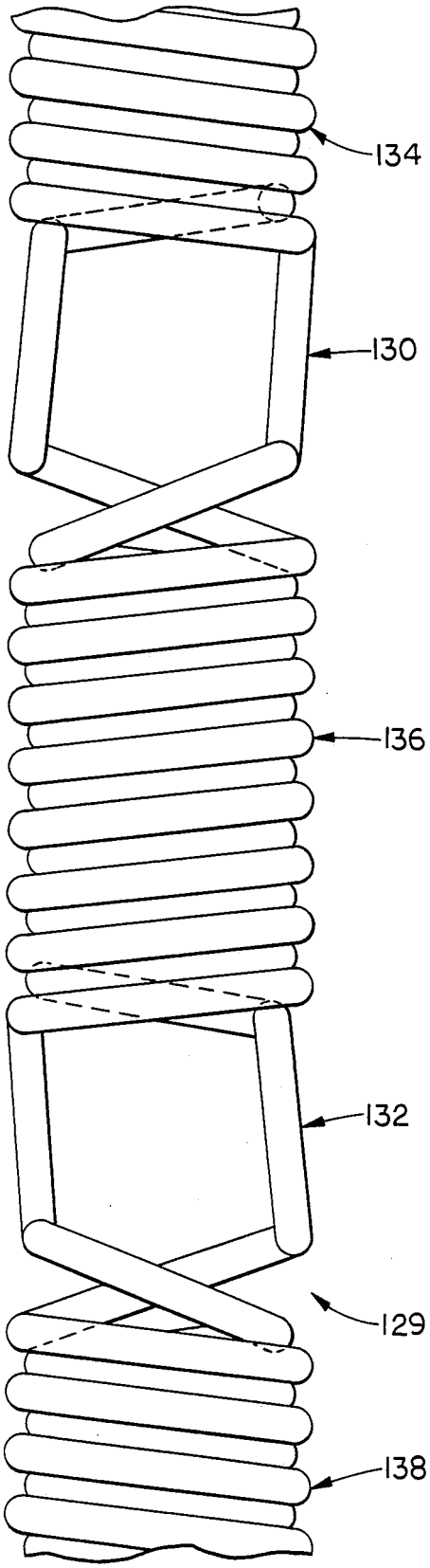
FIG. 8 is a fragmentary view of helical coils of a device constructed in accordance with another embodiment of this invention.

In FIG. 8 is shown a coil assembly 129 which includes two intermediate cross-over assemblies 130 and 132 and three coil section assemblies 134, 136, and 138. Otherwise, the coil assembly is substantially like the coil assembly already described.

The devices for condensing organic solvents and the like illustrated in the drawings and described above are subject to structural modification without departing from the spirit and scope of the appended claims.

Having described my invention, what I claim as new and desire to secure by Letters Patent is:

1. A condenser for separating solvent vapors from non-condensable gases which comprises a substantially enclosed outer shell, a middle shell inside the outer shell, the middle shell being open at a lower end, a substantially enclosed inner shell inside the middle shell, pipe means connecting the outer and middle shells, the pipe means passing through the outer shell and entering and discharging into an upper portion of the middle shell, means for introducing mixed solvent vapors and non-condensable gas through the pipe means to pass downwardly through an annular space between the inner and middle shells, there being a condensate receiving chamber in the outer shell bellow the lower end of the middle shell, a cold trap mounted in an upper portion of the condensate receiving chamber, means for introducing coolant into the cold trap to cool the cold trap, helical tube means mounted on the cold trap and receiving the coolant from the cold trap, the helical tube means extending upwardly through the annular space between the inner and middle shells for contacting by the mixed vapors, the helical tube means discharging into an upper portion of the inner shell, the coolant flowing downwardly inside the inner shell, means connected to a lower end portion of the inner shell and extending through the outer shell to remove the coolant from the shells, means for withdrawing condensate from the chamber in the lower portion of the outer shell, the non-condensable gas passing upwardly from the lower end of the middle shell through an annular space between the middle shell and the outer shell into a collecting space in an upper end portion of the outer shell, and means for withdrawing the non-condensable gas from said collecting space.

2. A condenser as in claim 1 in which the cold trap is hollow and circular in shape and is mounted coaxially with the outer shell in position for engagement by condensate in the outer shell.

3. A condenser for separating solvent vapors from non-condensable gases which comprises a substantially enclosed outer shell, a middle shell inside the outer shell, the middle shell being open at a lower end, a substantially enclosed inner shell inside the middle shell, pipe means connecting the outer and middle shells, the pipe means passing through the outer shell and entering and discharging into an upper portion of the middle shell, means for introducing mixed solvent vapors and non-condensable gas through the pipe means to pass downwardly through an annular space between the inner and middle shells, there being a condensate receiving chamber in the outer shell below the lower end of the middle shell, a cold trap mounted in an upper portion of the condensate receiving chamber, means for introducing coolant into the cold trap to cool the cold trap, helical tube means mounted on the cold trap and receiving the coolant from the cold trap, the helical tube means extending upwardly through the annular space between the inner and middle shells for contacting by the mixed vapors, means for removing the coolant from the shells, means for withdrawing condensate from the chamber in the lower portion of the outer shell, the non-condensable gas passing upwardly from the lower end of the middle shell through an annular space between the middle shell and the outer shell into a collecting space in an upper end portion of the outer shell, and means for withdrawing the non-condensable gas from said collecting space.

4. A condenser as in claim 3 in which the cold trap is hollow and circular in shape and is mounted coaxially with the outer shell in position for engagement by fluid passing up and down into the outer shell.

5. A condenser for separating solvent vapors from non-condensable gases which comprises a substantially enclosed outer shell, a middle shell inside the outer shell, the middle shell being open at a lower end, a substantially enclosed inner shell inside the middle shell, pipe means connecting the outer and middle shells, the pipe means passing through the outer shell and entering and discharging into an upper portion of the middle shell, means for introducing mixed solvent vapors and non-condensable gas through the pipe means to pass downwardly through an annular space between the inner and middle shells, there being a condensate receiving chamber in the outer shell below the lower end of the middle shell, helical tube means extending lengthwise of the annular space between the inner and middle shells for contacting by the mixed vapors, means for introducing coolant into the helical tube means for progressing therealong, means for removing the coolant from the helical tube means, means for withdrawing condensate from the chamber in the lower portion of the outer shell, the non-condensable gas passing upwardly from the lower end of the middle shell through an annular space between the middle shell and the outer shell, and means for withdrawing the non-condensable gas from the annular space between the middle shell and the outer shell.

* * * * *